United States Patent [19]

Mueller et al.

[11] Patent Number: 4,986,361

[45] Date of Patent: Jan. 22, 1991

[54] WELL CASING FLOTATION DEVICE AND METHOD

[75] Inventors: Mark D. Mueller, Santa Maria, Calif.; Frank Jones, Balikpapan, Indonesia; Julio Quintana, Bakersfield, Calif.; Kenneth E. Ruddy, Houston, Tex.; Michael Mims, Bakersfield, Calif.

[73] Assignee: Union Oil Company of California, Los Angeles, Calif.

[21] Appl. No.: 401,086

[22] Filed: Aug. 31, 1989

[51] Int. Cl.[5] ..... E21B 33/10

[52] U.S. Cl. ..... 166/381; 166/386; 166/77

[58] Field of Search ..... 166/380, 381, 386, 77, 166/191

[56] References Cited

U.S. PATENT DOCUMENTS

| | | | |
|---|---|---|---|
| 2,698,054 | 12/1954 | Brown et al. | 166/381 |
| 3,526,280 | 9/1970 | Aulick | 166/386 X |
| 4,308,917 | 1/1982 | Dismukes | 166/381 |
| 4,384,616 | 5/1983 | Dellinger | 166/376 |
| 4,396,211 | 8/1983 | McStravick et al. | 285/47 |
| 4,484,641 | 11/1984 | Dismukes | 175/61 |
| 4,589,495 | 5/1986 | Langer et al. | 166/383 |
| 4,683,955 | 8/1987 | Stepp et al. | 166/327 |

FOREIGN PATENT DOCUMENTS

| | | | |
|---|---|---|---|
| 0186317 | 7/1986 | European Pat. Off. . | |
| 3021558 | 7/1982 | Fed. Rep. of Germany . | |
| 547526 | 5/1977 | U.S.S.R. | 166/386 |

*Primary Examiner*—William P. Neuder

*Attorney, Agent, or Firm*—Gregory F. Wirzbicki; William O. Jacobson

[57] ABSTRACT

A ported float shoe and a landing collar are attached at one end of a casing string and a sliding air trapping insert attached by shear pins at the other end. The air trapping insert includes a fluid flow passageway blocked by a plug attached by shear pins to the insert. The air trapping insert and float shoe form an air cavity within the string portion. After running the string into a deviated well bore, the shear pin supported plug is pressure actuated open to allow air to be vented and drilling mud to flow into the cavity. A wiper plug followed by pressurized cement slurry shears away the attached insert, opens the float shoe, moves the insert to the bottom of the well, and allows cementing of the casing. Moved apparatus (near well bottom) forms a single drillable unit until drilled out in normal post-cementing operations. The flotation method reduces insertion drag and the related chance of a differentially stuck casing, and avoids the separate removal steps required by current flotation techniques. This method and device have the added benefit of safely venting air, and not adding a low density miscible fluid to the well bore casing annulus.

33 Claims, 4 Drawing Sheets

WELL CASING FLOTATION DEVICE AND METHOD

FIELD OF THE INVENTION

This invention relates to well drilling and well completion devices and processes. More specifically, the invention relates to an apparatus and method of setting liner or casing strings in an extended reach well, during oil, gas or water well completions.

BACKGROUND OF THE INVENTION

Many well completions involve setting a liner or casing string in a portion of the well bore. In some extended reach wells, such as wells drilled from platforms or "islands," a string must be set in a slant drilled (i.e., inclined angle) portion of a deviated hole. The inclined portion is located below an initial (top) portion of a lesser inclined angle. The angle (from vertical) of these inclined holes frequently approaches 90 degrees (i.e., the horizontal) and sometimes exceeds 90 degrees. The result is a well bottom laterally offset from the top by a significant distance. Current state-of-the-art allows extensive drilling of well bores at almost any angle, but current well completion methods have experienced problems, especially related to the setting of casing or liner strings in long, highly deviated well bores.

The liner or casing string is set in a pre-drilled hole. The drill string used to cut the hole is rotated, thereby reducing drag forces which retard the pipe string from sliding into the hole. The diameter and weight of the casing/liner string being set is larger and heavier than the drill string. Because of this, the torsional forces needed to rotate the casing or liner can be greater than the torsional strength of the pipe itself, or greater than the available rotary torque. Casing or liner strings are therefore normally run (i.e., slid) into the hole without drag reducing rotation.

Running in deviated holes can result in significantly increased (high) drag forces. A casing or liner pipe string may become differentially stuck before reaching the desired setting depth during running into a deviated or high drag hole. If sufficient additional force (up or down) cannot be applied, the result will be stuck pipe string and may result in effective loss of the well. Even if a stuck string is avoided, the forces needed to overcome high drag may cause serious damage to the pipe. These problems are especially severe for wells with long, nearly horizontal intervals.

Long, nearly horizontal well intervals may be needed for fluid production from tight reservoirs or from fields having limited surface access. Even for fields where reservoir permeability or access is not a problem, long horizontal well sections may be economically desirable because of higher production rates. Higher production rates may be possible in horizontal wells from zones where production of unwanted fluids (such as water/gas in oil fields) from adjacent beds, normally occurs in vertical wells, i.e., coning.

Common casing or liner running (i.e., installation) methods either (1) add downward force or (2) reduce the coefficient of friction, e.g., by lubrication. A modification of the added force approach provides bumpers to deliver downward shocks and blows in addition to added downward static forces.

Only a limited downward force can be exerted on the pipe string. The added downward force can convert a pipe string (normally supported from the top of the well) into a highly compressed member. Compression tends to buckle the string, adding still further drag forces (if laterally supported by the well bore) or causing structural failure (if laterally unsupported). In addition, large amounts of added downward force may be impractical.

Similar limits affect common lubricating or coefficient of friction reducing methods since the coefficient of friction cannot be reduced to zero. These lubricating methods do allow longer pipe strings to be run into an inclined hole. However, as longer lubricated pipe strings are run into an extended reach well, unacceptable drag forces will still be generated. The geometry and drilled surface conditions of some holes may also create increased resistance (high drag) conditions in shorter inclined holes, even if lubricating methods are used.

A flotation method of placing a pipe string into a deviated, liquid filled hole is also known. This method is illustrated in U.S. Pat. No. 4,384,616. After providing a means to plug the ends of a pipe string portion, the plugable portion is filled with a low density, miscible fluid. The low density fluid must be miscible with the well bore fluids and the formation. Miscibility and avoidance of air are required to avoid a burp or "kick" to or from the formation outside the pipe string. After feeding the string into the well bore, the plugs are drilled out and the miscible fluid is forced into the well bore/pipe annulus.

The known string flotation method requires added well completion steps, especially if cementing is required. The low density fluids compatible with the formation and bore fluid must be circulated out ahead of a cement slurry. This requires drilling out the plug(s) prior to cementing of the casing or liner string. Subsequent to the cementing, a second drilling out (of hardened residual cement) is frequently also required. The multi-step drilling result in costly well completions and increase the risk of damage to the string and formation.

None of the current approaches known to the inventors allow the flotation of a string into a high drag slanted well without a multi-step completion process. The cost of the multi-step completion has also apparently resulted in limited commercially practical application of the current flotation method.

A simplified flotation device and method are needed to allow the placement and completion of long pipe strings in extended reach well bores. The method and device should also be safe, reliable, and cost effective.

SUMMARY OF THE INVENTION

The invention provides a flotation plug device and process for running a casing or liner into a high drag inclined hole without the need to remove the plug device prior to cementing. A float shoe/float collar and a shear-pinned plug insert trap air within a portion of the casing string being run in a deviated hole. After running the string to the desired setting depth in a liquid filled hole, a sealed port in the insert is opened to allow the air to be vented to the surface. A cementing bottom wiper plug, induced by applied pressure, forces the plug insert to slide piston-like within the string to land and latch into a landing collar during normal cementing procedures. The latched insert/landing collar forms a single drillable assemblage. The assemblage is removed during normal post-cementing drilling out, avoiding multiple drilling steps.

The process first attaches a float shoe and/or float collar (having a flapper or check valve) and a landing collar at one end of an air filled flotation portion of the casing. The float shoe or collar prevents fluid inflow as the casing is lowered into the initial low angle portions of the fluid filled well bore. An insert forms the other end of the flotation portion. The insert includes a releasable plug (attached by a first set of shear pins) to block a passageway in the body of the insert and contain the air. When a sufficient "floating" length of string is run, the plug insert is attached within and pinned to the string with a second set of shear pins. This seals the air in the flotation cavity, creating a buoyant force on the pipe string in the fluid filled well bore.

The buoyant forces reduce effective weight, assisting the running of the string to the setting depth by reducing drag forces generated by the effective weight. After setting the string, increased internal string pressure shears the first set of shear pins, opening the passageway. This allows air to vent up the string while mud flows down. After circulation of the mud, a cement slurry is then pumped down-hole separated from the mud by a bottom wiper plug. The bottom wiper plug mates with the open ported insert and shears the second set of shear pins. Shearing releases the mated wiper plug and insert combination to move down-hole. The combination then latches to the landing collar, forming a single drillable assemblage. A top wiper (segregating cement slurry from the mud) may also be used. A differential pressure across the top wiper forces the cement slurry out and up the bore/string annulus. The assemblage (and top wiper, if used) is drilled out during normal post-cementing procedures.

The ported and slidable air trapping insert allows simplified running of long strings in inclined holes by controlled reduction of effective string weight, not by adding weight or reducing the coefficient of friction. Flotation is achieved without the need to 1) use a miscible low density fluid or 2) separately remove plugs prior to cementing the string. This method and device has the added benefits of possibly allowing a lower lifting capacity rig to be used (since the maximum effective hanging weight may be reduced) and increasing pipe setting depths, because of reduced drag forces.

BRIEF DESCRIPTION OF THE DRAWINGS

In these Figures, it is to be understood that like symbols and reference numerals refer to like elements, methods or features.

DESCRIPTION OF THE PREFERRED EMBODIMENT

Figure 1:
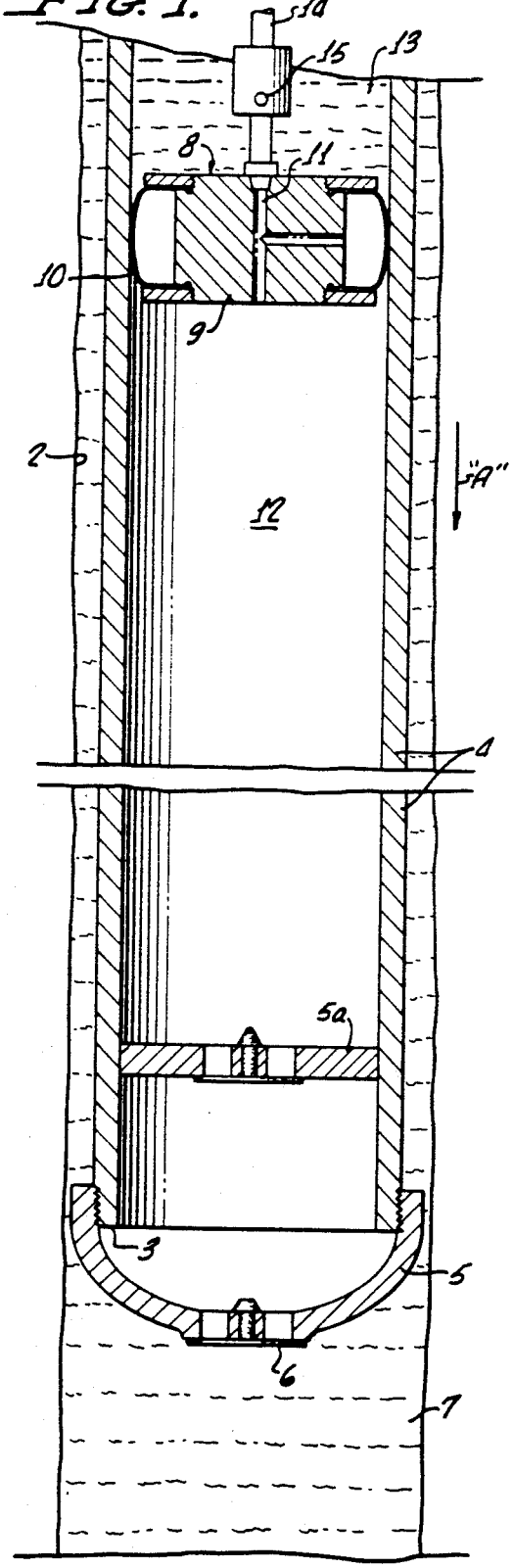
FIG. 1 shows a schematic cross sectional view of a device used to float a liner or casing.

FIG. 1 shows a schematic cross-sectional view of one embodiment for running a casing string (or liner or other duct) into a fluid filled bore hole (or cavity) 2. A portion of the casing or liner string 4 is placed in the top vertical or low angle section of drilled bore hole 2 (lower slanted or high angle portion not shown for clarity). The bottom end 3 of liner or casing string 4 has a float shoe 5 attached. The float shoe 5 includes an outwardly or downwardly opening flapper or check valve 6. The valve 6 prevents inflow of a bore fluid 7 during the running or lowering of the string (see downward direction "A" shown on FIG. 1) into the well bore 2. The flapper (or ball) of valve 6 may be spring or otherwise biased closed to prevent inflow, but allow pressurized fluid outflow (in the downward direction "A"). Outflow occurs if the pressure force within the string 4 can overcome flap seating forces and bore fluid 7 pressure forces.

A releasable and inflatable bridge plug (or packer) 8 is located at the other (second or top) end of a portion of the string to be floated. The bridge plug 8 comprises a cylindrically shaped solid form 9 and an elastomeric bladder 10. Pressurizing the bladder (or diaphragm) 10 through port 11 traps air or a flotation fluid within a flotation cavity 12 below the bridge plug 8 and prevents the entry of third (or non-flotation) fluid 13 from above the bridge plug 8 into cavity 12.

FIG. 1 shows the bladder 10 in a fully inflated position. Inflation is achieved by applying pressure through open air venting ports 15 in stem 14 (source of inflation air is not shown for clarity). Inflation also pressurizes the flotation cavity 12 to prevent collapse of the string under down hole conditions. After inflation, pulling or twisting of stem 14 closes the air venting ports 15 and the source of inflation can be removed.

The bore fluid 7 is normally a single density drilling mud, but may also be a mixture or several layers of different density fluids. The various densities within the well bore allow a single flotation cavity 12 to have different buoyant forces at different portions of the well bore proximate to different density bore fluids. This can be highly desirable in extremely high drag well bores.

The distance between the float shoe 5 at one end of the flotation cavity 12 to the bridge plug 8 at the other end is variable to allow control of buoyant forces generated. The float shoe 5 is installed at the surface before entry of the casing string end into the bore hole 2. The length of the flotation cavity or portion of the string is selected to control the force tending to run the casing into the hole. The bridge plug 8 seals and is attached to the duct by pressurizing the bladder after installing the length of "floating" pipe string portion into the bore hole 2.

The diameter and cross sectional thickness (and associated weight) of the pipe string enclosing cavity 12 can be set equal to the weight of the displaced bore fluid 7. This creates a neutral buoyancy so that this floating section exerts no upward or downward forces on the walls of the bore hole 2, regardless of orientation or slant. Even if neutral buoyancy is not desired, the controlled effective (buoyed) weight of the selected casing/liner pipe string which must be supported (hung) and any resulting drag during installation operations can be significantly reduced. This reduced maximum effective weight may allow a smaller capacity derrick or rig to be used, or added safety when using a larger one.

The remainder of the string above the bridge plug 8 is fluid filled with a heavier fluid, such as drilling mud. The larger effective weight of the remaining non-flotation portion forces the flotation cavity pipe string portion to the other (i.e., higher angle) portions of the well bore 2 (see FIG. 3). These other well portions may be nearly horizontal.

The non-flotation portion may extend to the surface, i.e, fill the remainder of the string with a heavier fluid. In some applications or embodiments, string installation may require a second or multiple floating portions within the string, separated by other bridge plugs 8.

After the casing is run to setting depth, a retrieving device is run on the end of drill pipe and latched on the retrieving stem (or fishing neck) 14. The ports 15 are opened by the action of the drill pipe latching or twisting onto the retrieving dog on stem 14. The ports 15 may also be remotely actuated in an alternative embodiment. These opened venting ports 15 allow the higher density third fluid 13 to exchange places with the lower density fluid (air) in cavity 12. The bridge plug 8 is also then deflated by pulling on the retrieving stem 14.

An alternative embodiment can separately actuate cavity pressurization/venting and bladder inflation/deflation. Cavity pressurization may not be required if the string can withstand the differential pressure. Fluids (air in this embodiment) used to inflate bladder and pressurize cavity can also be segregated in this alternative embodiment.

The fluid flow around and/or through bridge plug 8 allows air within the cavity 12 to rise and be vented from within the string 4 at the surface. This is in contrast to forcing a low density (miscible) fluid into the annular space outside the string. Fluid flow through plug 8 also allows cavity 12 to be filled with the higher density (or non-flotation) fluid 13. Non-flotation fluid 13 is typically a drilling mud but may be another higher density fluid. The drill pipe and bridge plug 8 may be removed from the casing 4 and normal cementing operations may commence. If the bridge plug is not removed, the float shoe attachment and the shape of the interfacing (after bridge plug slides down) top surface of the float shoe 5 and the bottom surface of the bridge plug 8 are designed to grab, preventing interface sliding and rotation during post cementing drilling out operations.

Float collar 5*a* serves as a redundant fluid inflow prevention means. The float collar 5*a* is similar in construction to the float shoe 5, including a flapper or check valve 6, and again prevents bore fluid 7 from entering the air filled cavity. The float collar 5*a* is attached to the pipe interior near the float shoe 5.

Alternative embodiments could also include a float collar 5*a* in place of (in contrast to redundant with) the float shoe 5 or the addition of a latch-in landing collar 16 (see FIG. 2) near the float collar 5*a*. The float collar 5*a* is again similar in construction to the float shoe 5 as discussed, and can form a flotation cavity away from the end of the string since it is attached to an interior portion of the string 4, rather than at the end of the string 4.

Figure 2:
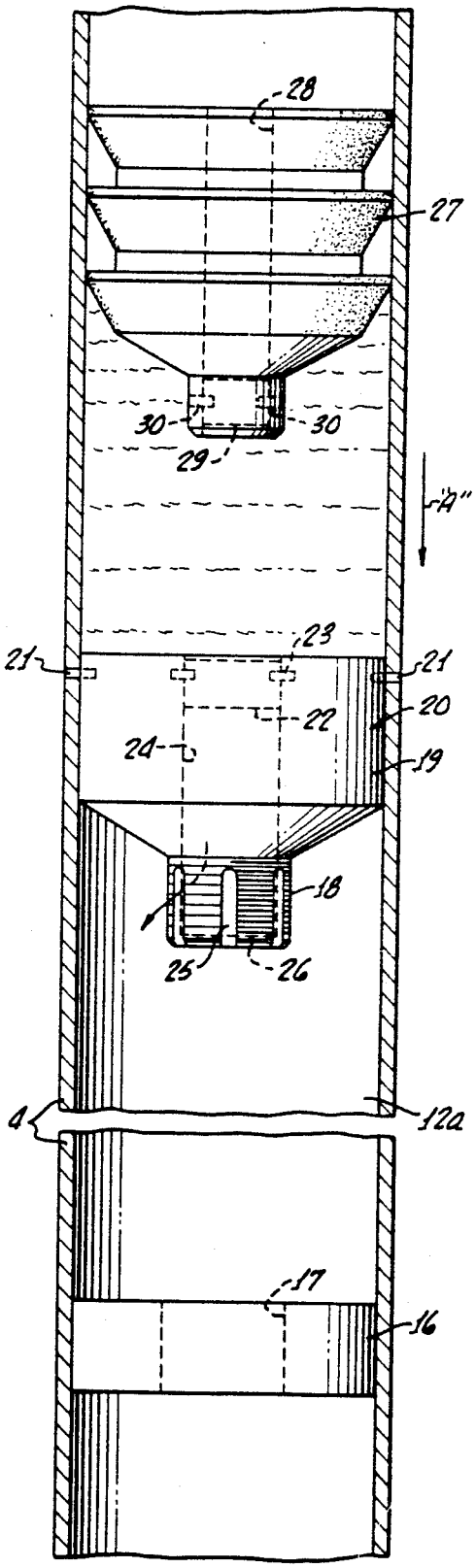
FIG. 2 shows a schematic side view of the preferred embodiment of a string flotation device during installation.

FIG. 2 shows a schematic side view of the preferred embodiment of apparatus for floating a portion of a casing or liner string during running. A latch-in landing collar 16 is attached to the casing or liner string 4 near the float collar/float shoe end (see FIG. 1) of the cavity 12*a*. The latch-in collar 16 includes a threaded or latching aperture 17 (shown dotted for clarity) which engages a threaded or latching protrusion 18 of an air release plug holder 19 of an air trapping device (or member) 20.

The piston-like air trapping device 20 also includes an air release plug 22 (shown dotted for clarity). A first set of (or passage) shear pins 23 attaches the release plug 22 to an internal port (or passageway) 24 (shown dotted for clarity) within the plug holder 19. A second set of (or plug holder) shear pins 21 attaches the plug holder 19 to the liner/casing 4. The size and shape of the plug 22 and internal port 24 allow the sheared away plug 22 to slide down (direction "A") toward the protrusion 18. After moving/sliding the plug 22 down, the internal port 24 is in fluid communication with both the cavity 12*a* below (through slotted ports 25) and the non-flotation fluid 13 above the translated plug 22. The lateral slotted ports 25 allow fluid passage to and from the lower portion of the internal port 24 and the cavity 12*a* (fluid flow shown as a solid and dotted arched arrow). The height of plug 22 is selected to be less than height of the slotted ports 25, allowing fluid flow in this lower portion. A basket 26 near the bottom of the air trapping device 20 acts as a retainer of the plug 22 within the internal port 24 when the passage shear pins 23 break and plug 22 moves downward under fluid pressure from above.

After venting the trapped air from the cavity 12*a* through port 24, filling the cavity 12*a* with drilling mud, and circulating drilling mud to the formation/string annulus (see FIG. 3), a cement slurry is introduced into the string above the air trapping device 20. A bottom wiper plug 27 separates the cement slurry above wiper plug 27 from the drilling mud 13 above the air trapping device 20. A third set of (or wiper) shear pins 30 attaches an inner wiper plug 29 to a wiper plug port 28 (shown dotted) of the wiper plug 27. The inner plug 29 prevents fluid communication above and below the wiper plug 27 until the inner plug 29 moves (i.e., is sheared away) from the plug port 28.

An initial (before wiper shear pins are sheared) fluid pressure from a source at the surface creates a differential pressure across the wiper plug 27. Pressure differential will tend to move the wiper plug 27 (direction "A") towards the air trapping device 20. When the wiper plug 27 element reaches the air trapping device 20 element, the elements are shaped to join together and be slidable even when joined. When the pressure differential across the wiper plug 27 is increased, a force that will rupture the plug holder shear pins 21 is then produced. The joined wiper plug 27 and air trapping device 20 will then slide toward the landing collar 16 as a unit. Upon reaching the landing collar 16, a further increase in pressure differential will rupture the wiper shear pins 30. Cement slurry above the wiper plug 27 can then circulate through landing collar 16, float collar if installed (not shown), and float shoe 5 (see FIG. 1) into the annular space between well bore 2 and casing 4.

Each set of shear pins is selected to rupture at an increasingly designated incremental pressure above normal operating hydrostatic pressure within the string. The preferred embodiment uses a differential pressure increment of 34 atmospheres (500 psi) to prevent accidental actuation (shearing). Thus the first set of shear pins 23 rupture at approximately 34 atmospheres (500 psi) over hydrostatic (allowing air to vent and mud to circulate), the second set of shear pins 21 (allowing the piston-like trapping device to translate) are set at approximately 68 atmospheres (1000 psi) over hydrostatic, and the third set of shear pins 30 (allowing cement slurry flow) are set at approximately 102 atmospheres (1500 psi) over hydrostatic.

FIGS. 3*a* through 3*f* show simplified representations of the preferred apparatus during well completion activities in the deviated well bore 2. When the inclined angle "i" (angle between the center line of the slanted well portion and the vertical shown in FIG. 3*a*) approaches larger values as shown, a positive means to prevent fluid inflow to the bottom of the air filled cavity is needed, i.e., float shoe 5. Lower incline angle holes may avoid using a float shoe, depending upon density differences and the lack of fluid miscibility to limit inflow to the flotation portion. Large incline angles "i" can also indicate the need for a flotation method of running the casing into the hole.

Large inclined angle "i" well bores are at most risk of a stuck casing string. At a critical angle and friction factor, the drag generated by the pipe section is equal or greater than the weight component tending to slide the pipe section into the hole. For friction factors ranging from 0.2 to 0.5, this critical angle ranges from 78.7 degrees to 63.4 degrees, respectively. Flotation methods are therefore indicated when the inclined angle "i" is greater than these critical values.

Figure 3A:
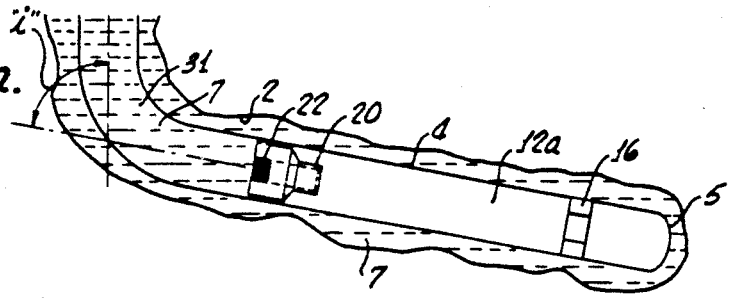
FIGS. 3*a* through 3*f* show simplified representations of the preferred devices during well completion activities.

FIG. 3*a* shows the initial apparatus positions after installing the string 4 in the deviated well bore 2. The cavity 12*a* includes landing collar 16 between the float shoe 5 and air trapping device 20. The air release plug 22 (shown darkened for clarity) is shear pin attached to air trapping device 20 (see FIG. 2). Cavity 12*a* contains trapped air, creating buoyancy during the (just completed) insertion of the string portion into the bore hole 2 containing drilling mud 7. In the preferred embodiment, drilling mud 7 is also the non-flotation fluid (see item 13 in FIG. 1) present above the air trapping device 20 in a non-flotation (or high density fluid filled) cavity portion 31. The apparatus geometry and mud density can be adjusted to control buoyancy and the effective weight of the casing 4 proximate to the cavity 12*a*.

Figure 3B:
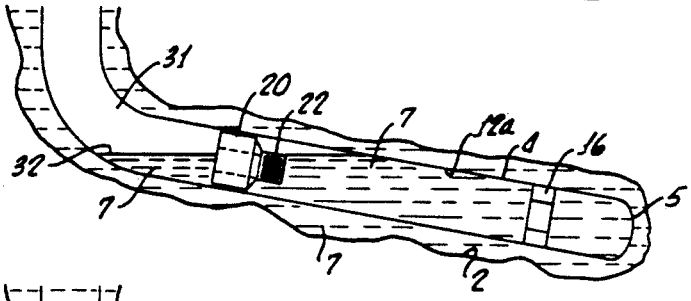

FIG. 3*b* shows the apparatus of FIG. 3*a* after rupturing the first set of shear pins 23 (see FIG. 2) and movement of the air release plug 22. An increased pressure above the air trapping device 20 sheared the first set of pins. The positions of the elements are unchanged except for the release plug 22. The sheared-away release plug 22 may be biased and/or pressure actuated to slide towards the cavity 12*a* to open ports 25 (see FIG. 2). Opening ports 25 allow fluid communication between the air cavity 12*a* and non-flotation (i.e., filled with a higher density fluid) cavity portion 31. Because of the fluid density differences, shape of the passage 24, downward sloping orientation of the bore hole 2, and fluid communication through the internal port 24 to the surface, the air from cavity 12*a* migrates upward in the casing or liner 4 so that it may be then vented at the surface. In wells that have an incline angle of greater than 90 degrees, it may be necessary to positively vent air from cavity 12*a*. As shown in FIG. 3*b*, the drilling mud 7 and displaced air form a mud-air interface 32 in the previously weighted cavity 31. The previously buoyant cavity 12*a* is now full of drilling mud 7.

An alternative embodiment can provide a plurality of internal ports 24 and release plugs 22. This embodiment would assure migration/displacement of fluids in a various orientations, e.g., one internal port primarily for venting air towards the surface, another for flowing drilling mud into cavity 12*a*.

Figure 3C:
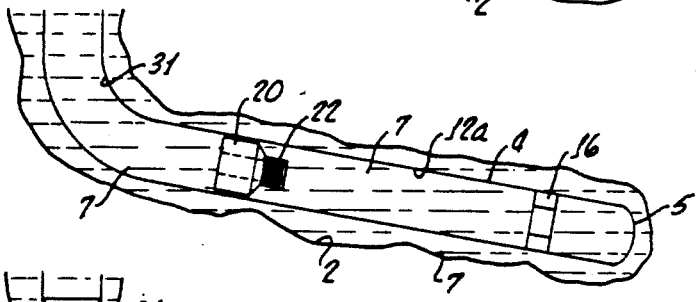

FIG. 3*c* shows the devices of FIG. 3*b* after the air (above the mud-air interface shown on FIG. 3*b*) is vented at the surface (not shown for clarity) and replaced with drilling mud 7. Position of the devices is unchanged, except that drilling mud 7 fills all of the string interior and the annulus between the liner/casing string 4 and well bore 2. Circulation of drilling muds is now possible, if required for hole cleaning or other reasons, without "burps" or "kicks."

Figure 3D:
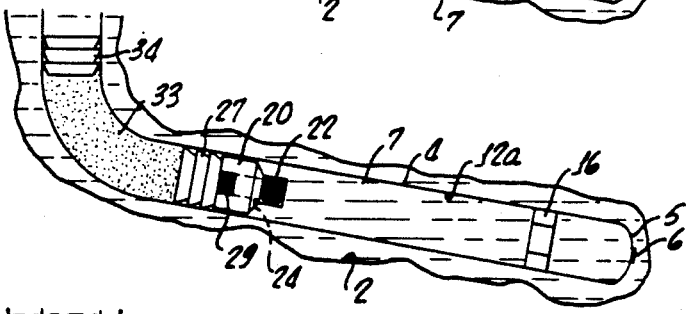

FIG. 3*d* shows the devices after installing and pumping a bottom wiper 27 (i.e., a plug wiping the interior surface of the string as it moves) to mate with the air trapping device 20. Above the bottom wiper 27 is a cement slurry 33. Drilling mud 7 within the casing 4 above air trapping device 20 has been displaced through passage 24 (See FIG. 2) in the air trapping device 20, landing collar 16, and flapper valve 6 of the float shoe 5 (see FIG. 1). To limit and segregate the top of a fixed amount of cement slurry 33, a top wiper 34 contains the cement slurry 33 between the two sliding and sealing wipers.

When forced by a differential pressure, the portion of the bottom wiper 27 proximate to inner plug 29 mates within the internal port 24 of the air trapping device 20 (see FIG. 2). This seating or mating of the bottom wiper 27 to the air trapping device 20 and a further increment of differential (above hydrostatic) pressure across the mated devices applies a shearing force to the second set of shear pins 21 (see FIG. 2).

Figure 3E:
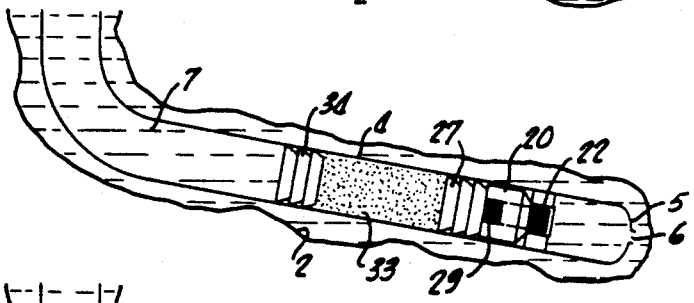

FIG. 3*e* shows the devices after breaking the second set of shear pins 21 (see FIG. 2) attaching the air trapping device 20 to the casing 4. The released air trapping device 20 and bottom wiper 27 are shown having been translated to land and latch or threadably engage the landing collar 16, which prevents rotation of the landed assemblage. Wiper plug 29 contains the cement 33 between the landed assemblage at the landing collar 16 and the top wiper 34. The drilling mud 7 previously contained in cavity 12*a* (see FIG. 3*d*) has been displaced and flowed though the landing collar 16 and flapper valve 6 of float shoe 5 into the annular space between well bore 2 and casing/liner 4. Displaced drilling mud continues to flow through the float shoe 5 until the top wiper 34 joins the assemblage. Applying another pressure increment tends to shear the third shear pin set 30 (see FIG. 2) holding the wiper plug.

Figure 3F:
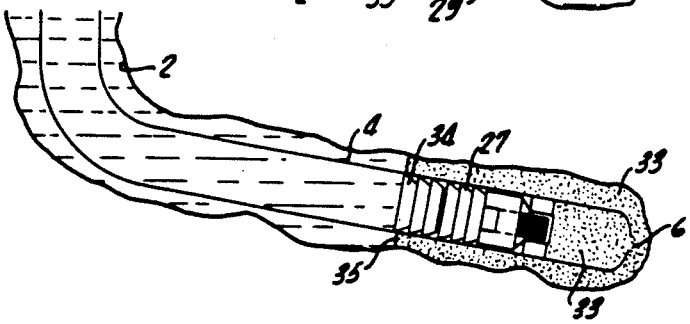

FIG. 3*f* shows the top wiper plug 34 joined to the assemblage and cement slurry 33 nearly fully displaced out of the string 4 to the annulus between the casing/liner 4 and well bore 2. Shearing the wiper plug allows the cement to flow through the bottom wiper plug 27 to the annulus between the casing 4 and well bore 2 (as shown by arrows out of flapper valve 6). The pressurized cement flow also causes the top wiper 34 to slide and contact the bottom wiper plug 27. The cement-mud interface 35 (previously separated by bottom wiper 27) is now in the annulus between the well bore 2 and casing 4. A portion of the cement slurry 33 remains between the assemblage and float shoe 5. This residual cement is drilled out (after setting) in normal post cementing operations (not shown).

Figure 4:
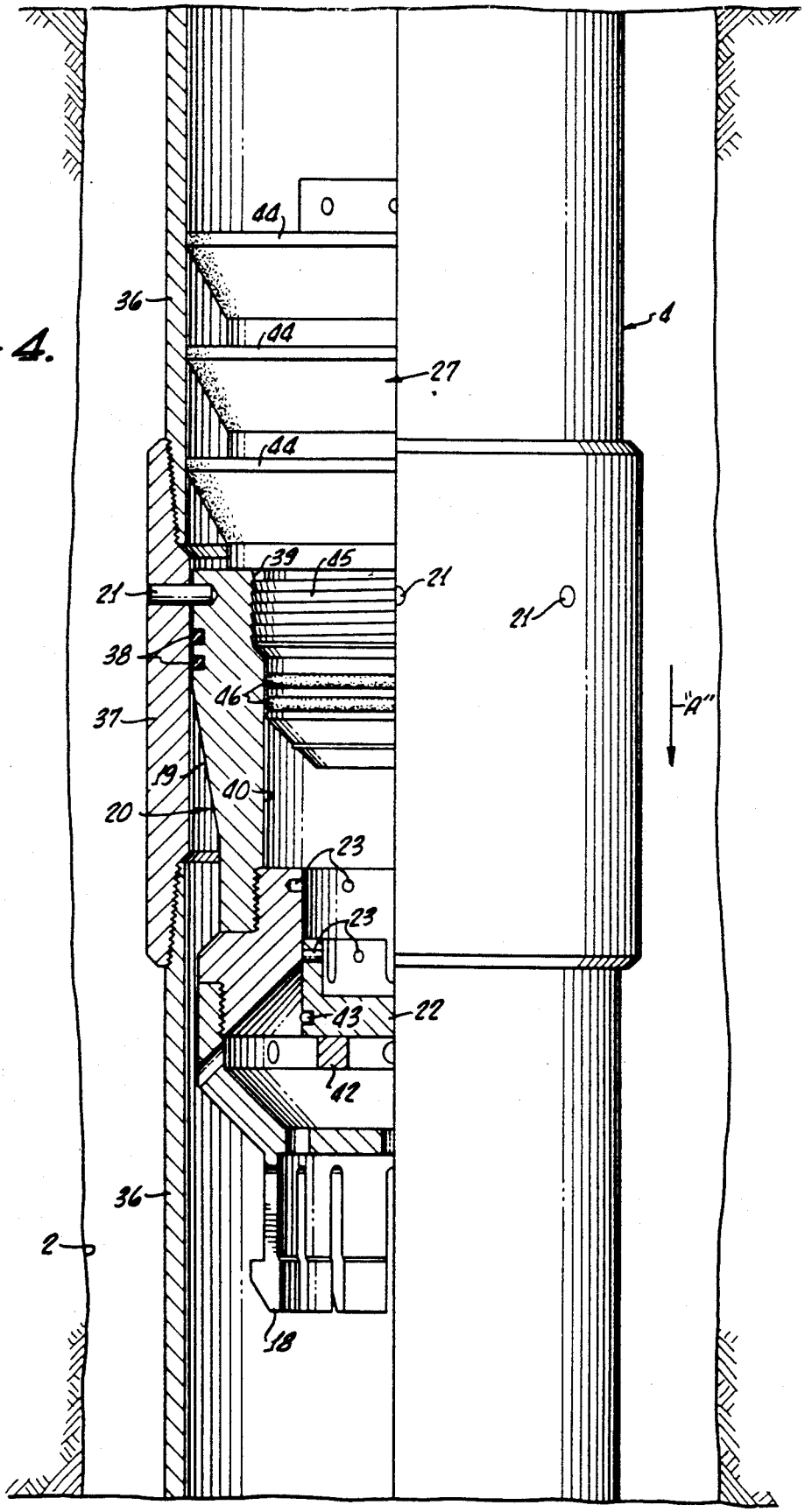
FIG. 4 shows a side and partial cross sectional view of the air trapping device portion of the engaged assemblage.

FIG. 4 shows a side and partial cross sectional view of the engaged bottom wiper 27 and pinned air trapping device 20 assemblage within a joint in the casing string 4. The casing string 4 (shown quarter sectioned) in hole 2 is composed of many sections of pipe segments 36 joined by a drift (or piping) collar 37 at each end. The piping collar 37 is internally threaded to join the external threaded ends of pipe segments 36. The illustrated pipe string joint is typical of the string of joined pipe segments. An alternative pipe string can used without interconnecting pipe segments, avoiding the need for a piping or drift collar 37.

The piping shown is attached to the air release plug holder 19 portion of the air trapping device 20 (shown in cross section) by the second set of shear pins 21. The air trapping device 20 also includes a pair of holder O-ring seals 38 forming a fluid tight sliding connection to the interior of the string 4. The internal port 24 (see FIG. 2) includes an initial threaded portion 39, a cylindrical wiper plug mating portion 40 and a release plug cylindrical portion 41.

The plug 22 was retained by the first set of shear pins 23 (shown sheared in FIG. 4). A pressure differential was applied sufficient to break the plug shear pins 23 and translate the plug 22 to rest against the perforated basket 42 (similar to basket 26 shown in FIG. 2). The plug 22 also includes a plug O-ring seal 43 which, when plug 22 is pinned in the initial position, formed a fluid tight sliding seal to the plug cylindrical portion 41 of the internal port 24 (see FIG. 2). The perforated basket 42 catches and prevents further translation or loss of the plug 22. The perforations of basket 42 and ports 25*a* allow fluids to pass around the displaced plug 22.

The air trapping device 20 also includes a latch protrusion 18 which attaches to the landing collar 16 (see FIG. 3) after the second set of shear pins 21 are broken and the assemblage has been displaced to landing collar 16. The protrusion 18 and latch or threaded portion 39 prevent rotation of the assemblage (wiper plugs, air trapping device and landing collar) when the assemblage is being drilled out.

The bottom wiper plug 27 (shown in side view for clarity within sectioned casing string 4) includes a series of elastomeric cup shaped wipers 44, an external threaded or latch portion 45 (threadably mating with the internal threaded or latch portion 39 of the air trapping device 20), a pair of elastomeric wiper O-rings 46 (shown darkened for clarity and bearing against the interfacing passageway portion 40), and (hidden from view) an inner plug 29 held in place within wiper port 28 by a third set of shear pins 30 (see FIG. 2).

Alternative embodiments can extend the bottom wiper dimensions to positively displace the plug 22 when mated (see FIG. 2), other types and locations of elastomeric seals, and other mating shapes and dimensions. Solid materials of construction are primarily 6061 aluminum, but various other materials of construction can be used, as long as they are drillable or otherwise removable.

The bottom wiper 27 acts as a sliding and wiping seal or separator along the interior of the casing. The bottom wiper 27 separates cement on the upstream side from fluid on the downstream side during certain fluid movements, i.e., slurry cement pumping down-well (direction "A"). The orientation (right hand engaging) of the external and internal threads shown in FIG. 4 are selected to tighten or engage the air trapping device during drilling and prevent unlimited rotation.

Several advantages of the preferred device to the prior flotation methods can be discerned. The first advantage is that the present invention avoids the need to use miscible flotation fluids. Air (or any other low density fluid) is safely contained and vented to the surface from within the string. A second advantage of the present invention is it avoids the need to remove wiper/-plug/insert devices in order to circulate mud or cement slurry. Shear pinned plugged ports open to allow flow for normal circulating, cementing, and drilling out or other operations.

A third advantage is the translating/latching ability of the preferred embodiment. The various components translate and latch together to form a single drillable unit latched to the landing collar. The unit or assemblage does not rotate or spin with the rotating drill, avoiding drilling difficulties. The drillable unit's location at a single known depth eliminates multiple drilling or retrieval operations at various depths.

These advantages are compounded if using multiple floating segments. The protrusion 18 can be designed to include an air trapping device nesting ability. The protrusion 18 would latch into the internal portion 39 of a second (nested) downstream located air trapping device. The nested air trapping devices again secure multiple segments within an assemblage at a single landing collar for post cementing drilling out procedures.

A further advantage of the preferred embodiment is the use of existing components, simple fabrication and design. The top and bottom wiper plugs can be produced by modifying a commercially available liner wiper plug. The use of 6061 aluminum results in light weight and easily machinable components.

Figure 5:
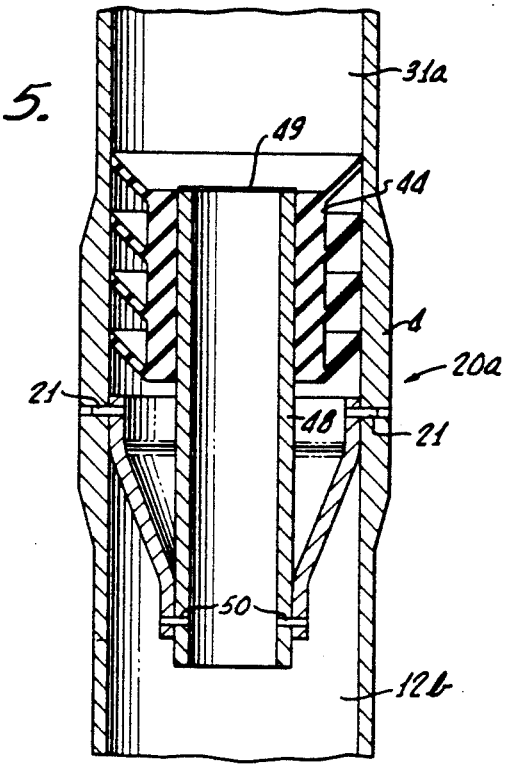
FIG. 5 shows a side cross sectional view of an alternative embodiment.

FIG. 5 shows a side cross sectional view of another alternative embodiment of an air trapping device or an air plug 20*a*. A second set of shear pins 21 attaches the air plug 20*a* to the casing pipe string 4. The air plug 20*a* is similar in construction to a conventional bottom cementing plug. The air plug 20*a* includes an aluminum insert 48 covered by rubber wipers 44. A rupture diaphragm 49 separates the flotation cavity 12*b*, retaining air or other low density fluid from the higher density fluid filled cavity 31*a*. The rupture diaphragm 49 replaces the releasable plug 22 and shear pins 23 of the preferred embodiment (see FIG. 2). The rupture diaphragm 49 has the advantage of simplicity, but may not be capable of withstanding the down hole pressures and forces or be removable without difficulty. Alternative embodiments could replace other slidable plugs and inserts with rupture or burst diaphragms.

Once the casing or liner string is run to the total or desired depth, increased pressure is applied to burst the diaphragm 49. Similar to the previous discussion, the ruptured diaphragm allows the trapped air from cavity 12*b* to migrate to the top of the well and be replaced by drilling mud. The air is again vented at the surface (not shown for clarity). Circulation of the drilling muds can now be accomplished, if required. Near normal cementing operations can now be accomplished. The cement slurry flows past the ruptured diaphragm until the top cement wiper 34 (see FIG. 2) engages the air plug 20*a*. Increasing the cement slurry pressure on the engaged air plug/wiper fractures the second set of shear pins 21. If the wipers 44 are slidably attached to the insert 48, another set of shear pins 50 can be used as a redundant means to allow fluid exchange in addition to the rupture diaphragm 49 (allowing fluid exchange even if rupture diaphragm does not rupture).

Results using the present invention are illustrated by the following example:

EXAMPLE 1

Figure 6:
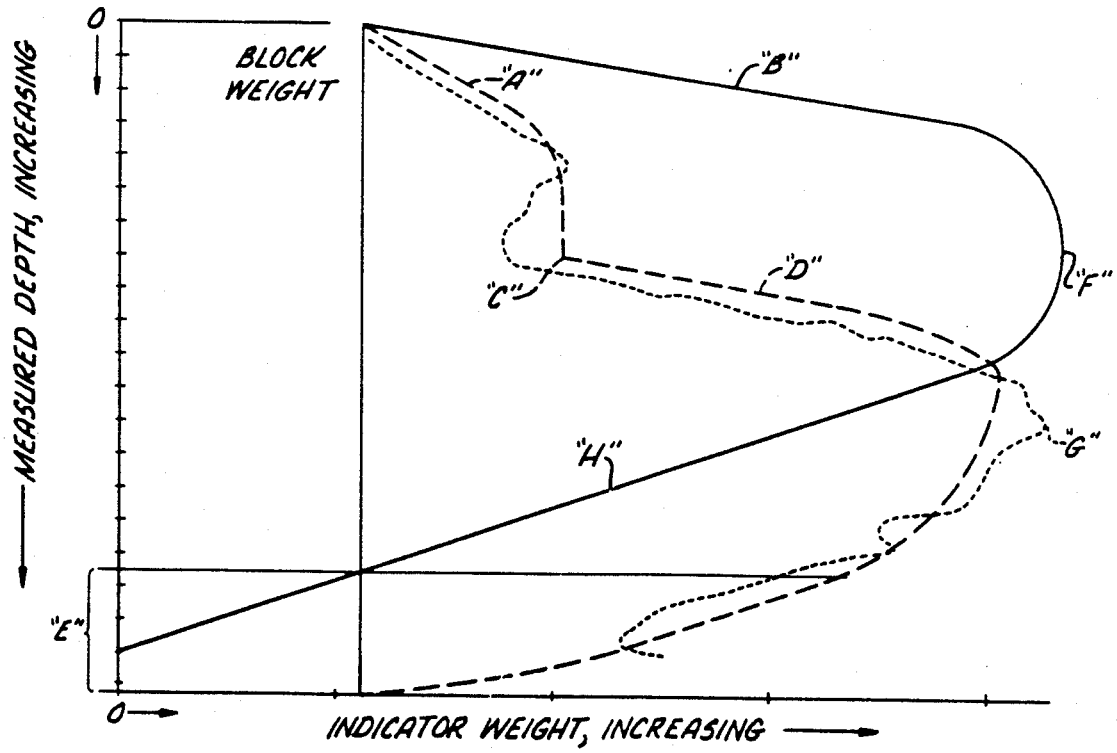
FIG. 6 is a graphical representation of the results of a test of the flotation method.

FIG. 6 is a graphical representation of the results of a test of the flotation method in an underground well bore. The devices and methods used were similar to those shown and described in FIG. 1. FIG. 6 shows the actual and expected indicator (or slack-off) weight supported during installation of the pipe string 4. The string was installed by sections from a derrick at the surface.

The bore fluid for this example was a drilling mud having a density related value of approximately 71 pounds/cubic foot. The casing used was a 9⅝ inch diameter pipe string. The resulting buoyed weight of mud filled casing was 40.4 pounds/foot, whereas the buoyed weight of the air filled cavity portion was 11.6 pounds/-foot.

After verifying air filled casing would not collapse under the increased pressure differential (when compared to the differential pressure resulting from a mud filled casing), approximately 4000 feet of casing (having a float shoe attached at the bottom end and centralizer bands on the bottom 2800 feet) was initially run into the hole to form the flotation cavity. An inflatable packer was set at the other end of the 4000 foot section and the remaining casing run into the hole. The dog on an inflatable packer was latched and air venting ports opened (see FIG. 1) for 15 minutes to allow the air to migrate to the surface for removal. Packer was then deflated (i.e., dog was twisted). Mud circulation was followed by generally normal cementing and post cementing (drilling) operations.

The expected results without flotation (solid curve), the expected results with flotation (dashed curve) and the actual indicator weight results using the flotation method and devices (dotted curve) are shown in the graph of FIG. 6. The initial actual (dotted line) and associated expected (dashed line portion "A") indicator weight increasing with depth shows a significant reduction in supported (indicator) weight, when compared to the non-flotation method (solid line portion "B" ), was achieved by the buoyant effect on the floated portion of the string within the fluid filled well bore.

The remaining string portion above the air filled cavity (point "C" on flotation expected curve) was filled with drilling mud. The actual and flotation expected curve shape (dotted and associated dashed line portion "D"), are similar to, but displaced from, the expected non-flotation curve shape (solid line "B"). This displacement allows the string to be placed to a greater depth (depth increment "E") before the supported weight becomes insufficient to move the string into the bore hole. The dotted and dashed curve shape (and ability to install casing or liner) can be altered by changing the number and length of the floated sections as well as by using a flotation fluid other than air or changing the density of the mud in the borehole or the mud above the flotation device.

During the installation in the initial low angle portion of the well bore, the prior art method (shown as a solid curve) was expected to produce a larger maximum force (or indicator weight as shown at point "F") to overcome the later developed frictional drag when compared to the flotation method maximum indicator weight (point "G"). However, as the casing end approaches the lower portion (solid line portion "H") beginning at approximately 2286 meters (7500 feet), the mud filled sections generate more drag (shown by the indicator weight declining with depth) than can be overcome by weight (i.e., exceeds critical incline angle). If the particular well included an even higher incline angle section, the decline in indicator weight would be even more severe.

The results of this test example show that flotation of the casing displaced and maintained a controlled margin of supported weight during the entire installation procedure, avoiding a stuck casing. The results also show that a reduced maximum indicator weight was achieved while allowing a deeper installation and avoiding extended reach, multiple drilling out procedures.

Still other alternative embodiments are possible. These include: a plurality of float shoe seals and air trapping plug seals (for seal redundancy); a single shear pin shearing at two points (located across a port or passageway and replacing one or more sets of shear pins); a sensor-actuated releasable latch or other releasable device to attach each plug to each passageway (replacing shear pins); placement of cylindrical or otherwise ported solid inserts (e.g., foam) or higher density fluid into the flotation cavity 12 in addition to lower density (flotation) fluids (to improve the control of buoyant forces); combining the float shoe, float collar, and/or the landing collar in a single component; combining centralizing (outward radial) protrusions on the string (to create a string stand off annulus within the well bore) with multiple trapping devices at pipe joints; replacing the float shoe valve with a float type trap or other back-flow preventer; and having translating components primarily composed of flexible material (to more easily navigate deviated sections). A still further alternative embodiment is to make portions of the devices from materials which are dissolvable, thermally degradable or fluid reactive/decomposing (avoiding pressure increments or drilling out procedures). Although no longer required, lubricants can also be used in conjunction with these flotation methods and devices to further control or reduce the running coefficient of friction.

These flotation devices and methods satisfy the need for a simple method to run a casing or liner string in a long horizontal well bore. Portions of the string are floated in the well bore fluids by providing one or more plugged buoyant cavities. Opening a circulation and cementing path can be accomplished by a simple increase in pressure and without device removal. Devices are removed by normal post cementing drilling out techniques, avoiding the need to separately remove flotation devices.

The use of air and lightweight materials minimizes storage and other related requirements. The present invention also reduces the maximum capability of the drill rig needed to accomplish the setting of the casing/-liner string. Further advantages of the device include: increased safety (avoiding large casing running loads at the drilling platform), reliability (reducing the likelihood of stuck casing), maintenance (single use, drillable components), efficiency (full flow production/ injection capability), and reduced cost (no separate removal step or need to recover items from great depth).

Although the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. An apparatus useful in installing a string of joined pipe sections from a surface into a well bore containing a first liquid, said apparatus comprising:

a pipe string portion, one end of said string portion forming one end of an air filled flotation cavity within the string;

a slidable member sealing and forming the other end of the flotation cavity, the slidable member having a passageway for conducting air out of the flotation cavity and liquid into the flotation cavity;

a plug sealing the passageway;

one or more first shear pins attaching the plug to the sliding member; and one or more second shear pins attaching the sliding member to the pipe string.

2. The apparatus of claim 1 wherein the one flotation cavity end also comprises a float shoe attached to the pipe string.

3. The apparatus of claim 2 wherein the slidable member also forms a first end of a non-flotation cavity adjacent to the flotation cavity within the string, and which also comprises:

a slidable wiper forming a second end of the non-flotation cavity; and means for filling the non-flotation cavity with a second liquid.

4. The apparatus of claim 3 which also comprises means for pressurizing the second liquid sufficient to shear the first shear pins and unseal the passageway.

5. The apparatus of claim 4 which also comprises: fluid pressure means for sliding the slidable wiper;

fluid pressure means for attaching the slidable wiper to the slidable member;

fluid pressure means for shearing the second shear pins; and fluid pressure means for sliding the attached wiper and member towards the float shoe.

6. The apparatus of claim 5 wherein the wiper also comprises a wiper port in fluid communication with the non-flotation cavity, and which also comprises;

a wiper plug sealing the wiper port;

one or more third shear pins attaching the wiper plug to the wiper port, and means for shearing the third shear pins.

7. An apparatus useful in installing a duct segment into a cavity containing a first fluid, said apparatus comprising:

a duct, a part of which forms a flotation portion capable of excluding some of said first fluid and containing a second fluid when said duct segment is installed in said cavity, said flotation portion having a first end generally distal from a second end;

means for sealing said second end;

means for unsealing said second end;

means for removing said second fluid from said duct through said unsealed second end;

wherein said apparatus is shaped and dimensioned to prevent contact of said removed second fluid from said excluded first fluid when said duct segment is installed in said cavity; and means for circulating a third fluid from said duct to said cavity and back to said duct when said second end is unsealed.

8. An apparatus useful in installing a duct segment into a cavity containing a first fluid, said apparatus comprising:

a duct, a part of which forms a flotation portion capable of excluding some of said first fluid and containing a second fluid when said duct segment is installed in said cavity, said flotation portion having a first end generally distal from a second end;

means for limiting inflow of said first fluid attached to said duct and forming said first end;

means for sealing said second end comprising: a slidable member having a fluid passageway shaped and dimensioned to allow removal of said second fluid from said flotation cavity, said slidable member located within said duct and forming said second end of said flotation portion; a plug capable of sealing said passageway; and means for releasably attaching said slidable member within said duct;

means for unsealing said second end;

means for removing said second fluid from said duct through said unsealed second end; and wherein said apparatus is shaped and dimensioned to prevent contact of said removed second fluid from said excluded first fluid when said duct segment is installed in said cavity.

9. The apparatus of claim 8 wherein said slidable member also forms a first end of a non-flotation portion within said duct, and which also comprises:

a slidable wiper within said duct forming a second end of said non-flotation cavity; and means for filling said non-flotation cavity with a third fluid.

10. The apparatus of claim 9 wherein said plug is first shear pin attached to said slidable member in a manner which unseals said passageway when said pin is sheared, and wherein said means for releasably attaching said slidable member comprises a second shear pin, said second shear pin attachment shaped and dimensioned to allow sliding of said slidable member after shearing.

11. The apparatus of claim 10 which also comprises:

means for shearing said first shear pin and unsealing said passageway;

means for sliding said slidable wiper;

means for attaching said slidable wiper to said slidable member to form a first joined element;

means for shearing said second shear pin; and means for sliding said attached wiper and member towards said inflow prevention means.

12. The apparatus of claim 11 wherein said slidable wiper also comprises a wiper port in fluid communication with said non-flotation cavity, and which also comprises;

means for releasably sealing said wiper port; and means for releasing said releasable sealing means.

13. The apparatus of claim 12 wherein at least one of said, first or second fluids is composed of a plurality of fluid layers having different densities.

14. The apparatus of claim 13 which also comprises:

means for inserting said duct segment into said cavity; and wherein the density of said second fluid is generally less than the density of said third fluid.

15. The apparatus of claim 14 wherein said wiper also forms the first end of a slurry cavity capable of containing a fourth fluid, and wherein said means for releasably sealing, said means for releasing, said shearing means, said attaching means, and said sliding means comprise:

a slidable wiper plug sealing said wiper port; and means for pressurizing said fourth fluid within said slurry portion sufficient to slide said wiper plug towards said slidable member to form a second joined element.

16. The apparatus of claim 15 wherein said pressurizing means is also sufficient to slide said slidable wiper plug and unseal said wiper port.

17. The apparatus of claim 16 which also comprises a means for preventing rotation of said first and second joined elements within said duct.

18. The apparatus of claim 17 wherein said first fluid is generally in a liquid state and said second fluid is in a generally gaseous state.

19. The apparatus of claim 7 wherein said sealing means comprises a bridge plug-like device.

20. The apparatus of claim 7 wherein said sealing means comprises an inflatable packer-type device.

21. The apparatus of claim 7 wherein said sealing means comprises a burst diaphragm-type device.

22. An apparatus useful in installing a duct segment into a cavity containing a first fluid, said apparatus comprising:

a duct, a part of which form a flotation portion capable of excluding some of said first fluid and containing a second fluid when said duct segment is installed in said cavity, aid flotation portion having a first end generally distal from a second end;

means for sealing said second end comprising a piston-like air trapping device having duct contactable elastomeric sliding seals, a fluid passageway, and a slidable plug blocking said passageway;

means for unsealing said second end;

means for removing said second fluid from said duct through said unsealed second end; and wherein said apparatus is shaped and dimensioned to prevent contact of said removed second fluid from said excluded first fluid when said duct segment is installed in said cavity.

23. The apparatus of claim 22 wherein said air trapping device is attached to said duct by the means of a second set of shear pins.

24. The apparatus of claim 23 wherein said slidable plug is attached to said trapping device by means of a first set of shear pins.

25. An apparatus for installing a duct within the boundary of an underground hole partially containing a first fluid comprising:

a duct shaped and dimensioned to be run into said hole;

a flow restrictor attached to one end of said duct so as to restrict flow of said first fluid into the interior of said duct portion;

a plug slidably attached within said duct so as to form a floatation cavity between said plug and said restrictor capable of containing a second fluid, said plug having a fluid communication port within said plug extending from said flotation cavity to an adjacent internal portion of said duct;

means for partially filling said adjacent cavity with a third fluid;

means for releasably blocking said port;

means for unblocking said port so as to allow a partial exchange of said fluids from said flotation cavity to said adjacent cavity;

means for removing said second fluid wherein said withdrawn second fluid does not contact said hole boundary;

means for sliding said plug towards said flow preventer until said plug contacts said flow restrictor;

means for attaching said plug to said flow restrictor;

means for removing said attached plug and flow restrictor from said duct; and means for circulating a third fluid from said duct to said hole and back to said duct when said port is unblocked.

26. The apparatus of claim 25 wherein said plug is composed of a fluid discomposable material.

27. The apparatus of claim 25 which also comprises a closed cell foam insert within said flotation cavity.

28. A process useful in installing a duct segment within a first fluid containing hole using a second fluid, a fluid inflow restriction device, a means for circulating fluid from the duct to the hole and back to the duct, and a fluid trapping duct insert, said process comprising:

attaching said fluid inflow restriction device to said duct segment to form one end of a flotation duct portion capable of containing a second fluid and generally capable of excluding said first fluid:

attaching said fluid trapping insert to the other end of said flotation portion within said duct segment;

installing said duct segment into said hole;

removing said second fluid from said duct segment without said second fluid contacting said excluded first fluid; and circulating a fluid from said duct segment to said hole and back to said duct segment.

29. The process of claim 28 wherein said fluid trapping insert is slidable within said duct segment having a sealed passage from said flotation portion to an adjacent portion of said duct segment, and which process step of circulating a fluid comprises:

opening said sealed passage after installing said duct segment, wherein said opening transfers said second fluid from said flotation portion to said adjacent portion;

filling said flotation portion with said second fluid before attaching said fluid trapping insert;

flowing a hardenable cement slurry through said duct segment after opening said passage; and removing said opened passage trapping insert after said cement slurry hardens.

30. The process of claim 29 which also comprises sliding said opened passage trapping insert towards said inflow prevention device prior to removing said trapping insert.

31. The process of claim 30 wherein said removing comprises drilling out of said insert, said inflow prevention device, and a portion of said hardenable cement remaining within said duct.

32. An apparatus useful in installing a duct into a cavity containing a first fluid, said apparatus comprising:

a duct, a part of which forms a flotation portion capable of excluding some of said first fluid and containing a second fluid when said duct is installed in said cavity, said flotation portion having a first end generally distal from a second end;

means for sealing said second end;

means for unsealing said second end;

means for removing said second fluid from said duct through said unsealed second end; and means for circulating at least a portion of a third fluid from said duct to said cavity and back to said duct after removal of said second fluid.

33. The apparatus of claim 32 wherein said circulating means is also a means for mixing said first and third fluids.

* * * * *